US007036450B2

(12) United States Patent
Freund et al.

(10) Patent No.: US 7,036,450 B2
(45) Date of Patent: May 2, 2006

(54) METHOD AND DEVICE FOR OPERATING AN UNDERWATER VEHICLE

(75) Inventors: Harald Freund, Kunreuth (DE); Rüdiger Kutzner, Erlangen (DE); Hauke-Hein Schulz, Dresden (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/240,820

(22) PCT Filed: Mar. 26, 2001

(86) PCT No.: PCT/DE01/01163

§ 371 (c)(1),
(2), (4) Date: Feb. 27, 2003

(87) PCT Pub. No.: WO01/76937

PCT Pub. Date: Oct. 18, 2001

(65) Prior Publication Data

US 2003/0154900 A1 Aug. 21, 2003

(30) Foreign Application Priority Data

Apr. 7, 2000 (DE) ..... 100 17 376

(51) Int. Cl.
*B63G 8/00* (2006.01)

(52) U.S. Cl. ..... 114/312

(58) Field of Classification Search ..... 114/312, 114/313, 330, 331

See application file for complete search history.

(56) References Cited

U.S. PATENT DOCUMENTS

| | | | | |
|---|---|---|---|---|
| 3,126,559 | A * | 3/1964 | Alexander | 441/2 |
| 3,515,133 | A * | 6/1970 | Parker | 128/201.27 |
| 3,664,366 | A * | 5/1972 | Munguet | 137/209 |
| 3,946,685 | A | 3/1976 | Chadbourne et al. | |
| 4,246,955 | A * | 1/1981 | Skala | 165/234 |
| 5,129,348 | A | 7/1992 | Rannenberg et al. | |
| 5,249,933 | A * | 10/1993 | Moody | 417/404 |
| 5,850,778 | A * | 12/1998 | Fischbach | 99/342 |
| 6,273,019 | B1 * | 8/2001 | Ciamillo, II | 114/312 |
| 6,772,705 | B1 * | 8/2004 | Leonard et al. | 114/333 |

FOREIGN PATENT DOCUMENTS

| | | |
|---|---|---|
| DE | 1220282 | 6/1966 |
| DE | 10017376 | 10/2001 |

* cited by examiner

*Primary Examiner*—Stephen Avila
(74) *Attorney, Agent, or Firm*—Harness, Dickey & Pierce, P.L.C.

(57) ABSTRACT

A method is disclosed for operating an underwater vehicle. According to the method, the pressure difference between a container which can be filled with water and/or gas, especially air, in order to alter the weight of the vehicle and the water pressure outside the vehicle, is regulated to a predeterminable set value. A suitable device for carrying out this method, includes a circuit for regulating pressure difference between the pressure inside the container an the water pressure outside the vehicle to a predeterminable set value.

27 Claims, 2 Drawing Sheets

METHOD AND DEVICE FOR OPERATING AN UNDERWATER VEHICLE

This application is the national phase under 35 U.S.C. § 371 of PCT International Application No. PCT/DE01/01163 which has an International filing date of Mar. 26, 2001, which designated the United States of America and which claims priority on German Patent Application number DE 100 17 376.4 filed Apr. 7, 2000, the entire contents of which are hereby incorporated herein by reference.

FIELD OF THE INVENTION

The invention generally relates to a method and an apparatus for operating an underwater vehicle.

BACKGROUND OF THE INVENTION

The floating state of a submersed submarine is produced by virtue of the fact that the buoyancy resulting at the desired diving depth is balanced by varying the weight. To raise the boat weight, water is taken up in this case in one or more containers of the submarine, so-called cells (flooding), while, to lower the boat weight, water is released to the outside from the cell(s) (pumped out). In this case, so-called regulating cells serve the purpose of coarse weight setting, while so-called deep pumping-out cells are provided for the fine balance. Consequently, the latter cells have a comparatively low volume, while the regulating cells can have a capacity of several hundred liters. The cross section of a pipe connection between a regulating cell and an opening in the boat's hull is appropriately large, so that a rapid variation in the filling level is possible in the relevant regulating cell. On the other hand, it is to be possible to set the filling level as exactly as possible in such a regulating cell, so that the volume of the additional deep pumping-out cells can be kept as small as possible. This requirement encounters the problem that a flap determining the beginning and end of the flooding or pumping-out operation of a regulating cell can be opened or closed in the above-named pipe connection only at a comparatively low speed of the order of magnitude of a few to approximately ten seconds. The respective actuating operation must therefore be begun early, particularly in the case of closure of this flap, long before the desired filling level is reached in the regulating cell. However, this lead time can only ever be determined with some degree of accuracy if the rate of flow in the relevant pipe connection to the regulating cell always has a known value, at least at the beginning of the closing operation, and is subjected as far as possible to no other fluctuations. It is then possible to precalculate, with some degree of accuracy, the volume of water presumably still flowing through by multiplying this flow rate value by the expected closure time of the flap as well as, if appropriate, a factor taking account of the variable position thereof, and thus to predict that filling level in the relevant regulating cell at which the closing operation of the flap must be initiated. On the other hand, the rate of flow in said pipe connection to the regulating cell is a function, in particular, of the pressure difference between the pressure inside the regulating cell and the outboard water pressure, and can therefore fluctuate strongly not only with the diving depth, but also, in particular, with the filling level inside the regulating cell. Thus, with the bleed valve closed the pressure in the regulating cell rises continuously during flooding, the outboard water pressure is substantially influenced, particularly in the case of low diving depths owing to the wave motion, etc., and so a multiplicity of factors act on the current rate of flow in the pipe connection to and from the regulating cell. Consequently, severe difficulties have been encountered to date in determining the correct instant to initiate the closing operation for the flap in the pipe connection from and to the regulating cell.

SUMMARY OF THE INVENTION

Disadvantages of the described prior art result in a problem initiating an embodiment of the invention of creating a possibility of how the filling level in a regulating cell of an underwater vehicle can be predetermined as accurately as possible such that additionally required deep pumping-out cells can be designed with a comparatively low volume. In particular, this may be achieved by virtue of the fact that the lead time for initiating the closing operation of a flap in the pipe connection from and to a regulating cell can be determined as exactly as possible.

A solution to this problem may be achieved by virtue of the fact that the pressure difference between, on the one hand, the pressure in a container that can be filled with water and/or a gas, in particular air, for the purpose of varying the vehicle weight and, on the other hand, the outboard water pressure is regulated to a predeterminable set value.

Since the volume throughput during the flow of a viscous medium through a pipe is proportional, in accordance with the Hagen and Poisseuille law, to the pressure difference between the pipe ends, it is possible by regulating this pressure difference to a preferably permanently predetermined value to create an optimum precondition for the volume throughput of the water through the pipe from and to the relevant regulating cell remaining largely constant in the case of an unchanged angular position of the flap. Since the influence of the angular position of the flap on the volume throughput can be determined experimentally, the lead time for initiating the closing operation of the flap in the pipe connection from and to the regulating cell can be determined very exactly. Assuming an approximately constant pressure difference, the experimentally determined value can be used to estimate the water still flowing through the flap during the closing operation, and to determine therefrom a lead value for the filling level at which the closing operation for the flap is to be initiated such that at the end of the latter the desired filling level is established as exactly as possible in the regulating cell.

It has proved to be favorable that the actual value of the pressure difference between, on the one hand, the pressure in a container that can be filled with water and/or a gas, in particular air, for the purpose of varying the vehicle weight and, on the other hand, the outboard water pressure is measured. Of course, this pressure difference can be detected by two sensors of which one is assigned to the outboard water pressure, and the other to the internal pressure in the relevant regulating cell, these sensors preferably requiring to be arranged approximately in the vicinity of the relevant pipe orifice; in such a case, the pressure-difference could be produced by subtracting the sensor output signals afforded or converted to identical measuring ranges. On the other hand, the measurement outlay can be reduced by using for the pressure difference a single pressure sensor whose output signal can then be used directly as actual value for the closed loop according to an embodiment of the invention.

It is within the scope of an embodiment of the invention that the measured actual value of the pressure difference is subtracted from the predetermined set value in order to obtain a measure of the system deviation. The further tasks of the closed loop according to an embodiment of the invention can be simplified by way of this difference formation to the effect that the signal for the system deviation is balanced as far as possible to zero.

For this purpose, in the course of the regulation for the pressure difference, a function proportional to the system deviation, its integral and/or differential can be formed as inventive regulating signal. Such regulating functions permit a high precision of the regulation in relation to cost-effective implementations such as, for example, two-step controllers, that can also be applicable in individual cases, on the other hand. The selection of the correct controller structure, and also the determination and optimization of the controller parameters can be undertaken in this case with regard to desired properties such as, for example, dynamics and stability of the regulation.

An embodiment of the invention permits a development to the effect that, in order to improve the dynamics in the event of set value changes, the regulating signal is combined additively with a signal, derived from the set value by differentiation, to form a dynamized regulating signal. Such an arrangement permits the actual regulating function to be formed without a differential component such that a very smooth regulation is performed without set value changes, and the risk of instabilities is thereby greatly reduced.

It has proved, furthermore, that the, if appropriate dynamized, regulating signal is influenced by one or more signals. Specific boundary conditions that are to be observed in the system to be adjusted are thereby satisfied.

The, if appropriate dynamized, regulating signal can experience a first modification through a filling level measured value for the container that can be filled for the purpose of varying the vehicle weight, in order thereby to obtain a regulating signal corrected for filling level. This modification takes account of the fact that, given a high filling level, only a comparatively small air volume is present in the relevant regulating cell, and so even ventilating or bleeding a comparatively small volume of air leads to strong pressure changes in the regulating cell, while given a low cell filling level the movement of substantially larger quantities of air is required for this purpose. The modification could be effected in this case in such a way that the measured filling level is subtracted from the maximum filling level in order to make available a measure of the air volume still present, and that this value proportional to the air volume is subsequently multiplied by the, if appropriate dynamized, controller output signal.

A further, alternative or cumulative possibility of modification can be derived from a pressure signal for the outboard pressure, in order to obtain a regulating signal corrected for diving depth. The aim in this case is chiefly to comply with the fact that given low diving depths the fluctuations in the external pressure that are caused by the wave motion may possibly be of the order of magnitude of the desired pressure difference, and could therefore give rise to extreme oscillations within the regulating circuit according to an embodiment of the invention. Since cases of instability could arise therefrom in unfavorable cases, it is possible to attenuate the regulating signal for low diving depths within the scope of such a diving depth correction, in order to stabilize the regulating circuit thereby.

Finally, it is also possible to provide that the regulating signal, if appropriate dynamized, corrected for filling and/or corrected for diving level, is bounded in order to correspond to further set values, in particular with regard to the noise requirement. Here, bounding is also to be understand in the sense of a reduction in the proportionality factor at large amplitudes of the regulating signal, in order, for example, to avoid robust and therefore loud regulating measures, something which can be important with military underwater vehicles, in particular.

The regulating concept according to an embodiment of the invention can be supplemented advantageously with a lower-level regulation for the rate of change in the pressure difference to which is communicated, as set value, the pressure difference regulating signal which, if appropriate, is dynamized, corrected for filling level, corrected for diving level and/or bounded. This multipartite regulating structure can be used to avoid discontinuities in the rate of change in the pressure difference, this likewise resulting in calming the regulating circuit such that the noise produced by the arrangement can be lowered to a minimum.

The actual value, required for the lower-level regulating circuit, for the rate of change in the pressure difference can be determined, according to the teaching of an embodiment of the invention, by differentiation from the measured actual value of the pressure difference between, on the one hand, the pressure in the relevant regulating cell and, on the other hand, the outboard water pressure. Since such a differentiation can be implemented without difficulty by means of cost-effective electronic modules, there is no technical impairment to cascade regulation in accordance with an embodiment of the invention. A further step in the method according to an embodiment of the invention includes, in order to obtain a measure of the system deviation of the lower-level regulation for the rate of change of the pressure difference, the rate of change of the pressure difference actual value is subtracted from the regulating signal, used as set value signal and modified, if appropriate, of the higher-level regulation for the pressure difference between regulating cell and outboard water pressure. This method step serves to simplify a downstream regulation by virtue of the fact that the task thereof is reduced to nulling the measure, determined in such a way, of the system deviation of the lower-level regulation.

Furthermore, in order to improve the dynamics in the event of set value changes in the predeterminable pressure difference set value, it is possible to undertake a correction of the system deviation signal of the lower-level regulation for the rate of change in the pressure difference with the aid of the pressure difference set value, in particular by use of a signal derived by differentiation from the pressure difference set value. At this juncture, too, it is possible to incorporate a differential component derived from the predeterminable pressure difference set value since, owing to the lower-level closed loop for the rate of change in the pressure difference actual value, it is possible, if appropriate, to avoid a sudden variation in this controlled variable.

It is also advantageously possible within the scope of the lower-level regulation for the rate of change in the pressure difference to form a function, proportional to the, if appropriate dynamized, system deviation, its integral and/or differential as regulating signal for the rate of change in the pressure difference. In order to avoid sudden changes in the controlled variables, the differential component should in this case not be selected too large, or even omitted.

In a development of the idea of the invention, it is further possible to provide that the regulating signal, in particular for the rate of change in the pressure difference, is used to derive drive signals on the one hand for a ventilation valve arranged upstream of the container connection for a gaseous pressure medium, and on the other hand for a bleed valve arranged downstream of the container connection for the pressure medium. The controlled system according to an embodiment of the invention has the special feature that the ventilation valve must be opened to raise the cell pressure, there being a need for the bleed valve arranged downstream thereof to be closed, in order to avoid pressure losses, but on the other hand there being a need for the ventilation valve to be closed upon opening of the bleed valve, for the purpose of lowering the cell pressure. The regulation signal relevant for exerting influence on the system must therefore be used to generate drive signals for two actuators, one each of the actuators designed as valves being assigned to one each of the two, possible pluralities of the relevant regulating signal.

The drive signals to be generated from the relevant regulating signal should in this case be constituted such that they effect a continuous adjustment of the relevant valve. It is possible as a result to influence continuously the intensity of the air flow such that a very sensitive and thus extremely stable regulation can be achieved.

The actual position of the ventilation and bleed valves to be actuated can, occasioned in turn by fluctuating boundary conditions, deviate from the desired position in accordance with the drive signals, for example as a consequence of manufacturing tolerances, voltage fluctuations, corrosion-induced increases in friction coefficients, wear, etc. In order, nevertheless, to be able to move the valves exactly to the desired position, it is furthermore provided in accordance with the invention that the current valve positions are detected. The regulation system according to an embodiment of the invention or the drive circuit therefore receives a check-back signal that provides it with information on whether the calculated valve position values have actually been reached.

The feedback of the current valve positions further permits mutual interlocking of the two valves in such a way that the drive signals for one valve are combined with the current valve position of the respective other valve. It is possible thereby to ensure that a valve is not opened until the other is completely closed, in order to avoid pressure losses.

A further preferred feature of the invention resides in the fact that the drive signals for the valves are obtained from the regulating signals, if appropriate modified by interlocking, in particular for the rate of change in the pressure difference by one lower-level valve position regulation each. Such a positional regulation for the active part of the ventilation and bleed valves ensures a very highly precise adjustment, the respectively required drive signals being generated individually by the relevant closed loop with the amplitude required for the relevant valve position.

Again, in the course of a valve position regulation, the detected valve position value should be subtracted from the regulating signal used as set value and modified by interlocking, if appropriate, in particular for the rate of change in the pressure difference, in order to obtain a measure of the system deviation. If this signal for the system deviation is nulled, the relevant valve has therefore assumed the position determined by the higher-level regulating signal, and the higher-level regulating circuit can always precede from an optimum observance of the required valve positions, even if the electrically or mechanical parameters of the affected valves differ from one another in detail.

The system deviation can be minimized, in particular, by virtue of the fact that, in the course of the valve position regulation, a function proportional to the system deviation of the valve position, its integral and/or differential is formed as drive signal for the relevant valve. In particular, an integral-action component leads in this case to the fact that the drive signal is raised or lowered until the valve has assumed the position predetermined for it, and the system deviation has been nulled as a result.

In order to carry out the method according to an embodiment of the invention, an underwater vehicle according to an embodiment of the invention must be equipped with a correspondingly designed apparatus. This is distinguished by a circuit for regulating the pressure difference between, on the one hand, the pressure in a container that can be filled with water and/or a gas, in particular air, for the purpose of varying the vehicle weight and, on the other hand, the outboard water pressure, to a predetermined set value.

Such a circuit arrangement can be implemented in a highly deviated way. On the one hand, there is a possibility of constructing the individual components of this circuit mechanically; to save weight and space, however, it is possible, with the exception of the sensors and actuators, also to use electric or electronic components, and it is also possible, finally, to combine these components to form an integrated circuit, it also being possible to design the latter as a programmable module that acquires its function from a specific control program. Common to all regulating concepts of this type is that the internal pressure in the relevant regulating cell is influenced via one or more actuators in such a way that it is always corrected with reference to the outboard water pressure with the aid of an offset corresponding to the predeterminable pressure difference set value. Serving thereby as actuators influenced by this circuit are the ventilation and the bleed valves for the relevant regulating cell, and an actual value signal required for the feedback is generated by one or more pressure sensors.

Although the pressure difference actual value can also be generated by use of separate pressure sensors for the regulating cell pressure on the one hand, and the outboard water pressure on the other hand, an embodiment of the invention prefers the use of a single sensor for the pressure difference between, on the one hand, the pressure in the regulation cell and, on the other hand, the outboard water pressure. Since such differential pressure sensors occasion only a slight extra structural outlay, and on the other hand the vulnerability is reduced by a reduction in the components, this arrangement deserves to be preferred. Again, this reduces the outlay on calibration and likewise eliminates an electronic subtraction module.

Further advantages are offered by a device for subtracting an output signal of the sensor for the pressure difference between the container internal pressure and the outboard water pressure from a predeterminable set value signal. This device generates in such a way a signal for the current system deviation that can be nulled by adjusting the actual value.

Within the scope of the regulating circuit according to an embodiment of the invention, the output signal of the subtraction device for the set value and actual value of the pressure difference can be fed to the input of a controller module whose output signal is proportional to its input signal, the integral and/or differential thereof. Here, the integral-action component preferably serves the purpose of exactly nulling the system deviation permanently, while a differential component, although admittedly improving the dynamics of the regulating circuit, on the other hand should, however, rather be kept small in order to avoid instances of instability or to damp oscillations possibly initiated by the motion of the sea. As a further constituent of the regulating circuit according to an embodiment of the invention, it is possible to provide an addition device in which a signal derived from the pressure difference set value, in particular by differentiation, is added to the output signal of the pressure difference controller module, in order to obtain a dynamized regulating signal. This method can be used for the purpose of producing a dynamics reacting selectively to set value changes, while rapid changes in the actual value that can also be simulated, in particular, by the motion of the sea, are damped, or at least not amplified by omitting a differential component in the controller according to an embodiment of the invention.

As already set forth above, the properties of the controlled system are influenced by a multiplicity of further factors, and in order to undertake an adaptation of the regulating signal here, it is possible to arrange at least one module downstream of the controller module or the addition device connected to the latter on the output side, for modifying the regulating signal with the aid of one or more signals. These modification modules can act on the regulating signal in the most varied ways: in a fashion which is amplifying, attenuating, bounding, etc.

The regulating signal can, for example, be modified by a module that is fed the output signal of a sensor for the filling level in the relevant regulating cell. Because this modification module receives information on the current filling level in the relevant regulating cell, the module can adapt the regulating signal as appropriate to the remaining air volume, and this module can be designed for this purpose as a multiplier that multiples the regulating signal by a factor proportional to the remaining air volume.

The output signal of the sensor for the outboard water pressure can be connected to the signal input of another module for the, if appropriate further, modification of the regulating signal, as a result of which this modification module can determine the current diving depth at least approximately. Its task is to attenuate the regulating signal in the case of low diving depths and thereby to dampen oscillations in the regulating circuit such as are initiated by the motion of the sea in the case of such low diving depths. It can therefore have a transmission function which has the value of approximately 1 in the case of greater diving depths, but a value of less than 1 in the case of lesser diving depths.

Another module, once again, that is preferably used to bound the, if appropriate modified, regulating signal as an input for a predetermined or predeterminable set value signal with regard to the noise requirement. In accordance with this noise set value, the regulating signal can be throttled or attenuated by being bound, such that all the actions of the regulating circuit are executed with a reduced intensity, and both abrupt switching changes and strong air and/or water movements are thereby avoided.

In order to improve the regulation properties, an embodiment of the invention provides a cascade regulation system having a lower-level circuit for regulating the rate of change in the pressure difference, whose set value input is fed the, if appropriate modified, output signal of the pressure difference controller module. Such a controller structure offers the advantage that the rate of change in the pressure difference is not largely left to itself, but corrected as exactly as possible to a set value signal influenced, if appropriate, by the most varied modification modules. This provides a further intervention point to which the modification modules already described above can be coupled, on the one hand, while on the other hand the response to set value changes of the relevant regulating circuits can be predetermined by optimized controller structures and/or parameters independently of one another by separating the controllers for the higher-level and lower-level regulating circuits. It is within the scope of the invention that the output signal of the sensor for the pressure difference between, on the one hand, the pressure in the relevant regulating cell and, on the other hand, the outboard water pressure is fed to a module that calculates the time differential therefrom. It is possible with the aid of this module to determine an actual value for the rate of change in the pressure difference from the preferably continuously measured actual value of this pressure difference between the regulating cell and outboard water pressure. Here, this module can be designed as an analog differentiator such that the differential is determined virtually in a fashion free from delay and at any instance, and on the other hand it is also possible to take sample values in short time intervals from the pressure difference actual value signal, digitize these values and determine the differential from the difference between successive digital values.

The further processing of this actual value signal for the rate of change in the pressure difference takes place in a subtraction device, where this signal is subtracted from the, if appropriate modified, output signal of the pressure difference controller module, in order to obtain a signal for the system deviation of the lower-level regulation circuit for the rate of change in the pressure difference. A signal is thereby created whose absolute value of the amplitude constitutes a criterion for the distance of the actual operating point from the desired operating point, and is nulled by a controller module by varying the operating point of the system.

The cascade regulation system according to an embodiment of the invention offers the further possibility of adding a signal derived from the pressure difference set value signal, in particular by differentiation, to the signal for the system deviation of the lower-level regulating circuit for the rate of change in the pressure difference, in order to obtain a dynamized system deviation signal for the lower-order regulating circuit. This is preferably carried out in an addition device that is fed the relevant signals; if appropriate, this addition device can also be integrated with the subtraction device for forming the system deviation of the lower-level regulating circuit, for example by parallel connection of a plurality of inputs at the inverting and/or non-inverting input of an operational amplifier. By virtue of the fact that a coupling possibility is created here for a differential component obtained from the pressure difference set value signal, on the one hand it is possible for this component to be led past the higher-level controller in order to reduce the tendency of the latter to oscillate, and on the other hand it is possible for discontinuities, stemming from this differential component, in the system deviation signal for the lower-level regulating circuit largely to be kept away from the actuators by an appropriate design of the lower-level controller, such that the speed of actuation of said actuators does not exceed a predetermined value.

In a development of the idea of the invention, the controller module of the lower-level regulating circuit can be designed in such a way that its output signal is proportional to the, if appropriate dynamized, system deviation signal, present at its input, for the rate of change in the pressure difference; alternatively or in addition thereto, it is also possible for the output signal to include a component proportional to the integral and/or differential of its input signal. Such controller structures are known in the prior art and adequately investigated. The controller can be adapted to the relevant system by different weighting of the various components in the controller function; for example, the differential and, if appropriate, also the proportional component can be provided with a small weighting factor in order to avoid discontinuities in the controller output signal.

The pressure in the regulating cell can be increased by opening a compressed air valve upstream of the container connection for filling the same with a gaseous pressure medium, in particular compressed air, such that the pressure medium can flow from a supply pressure vessel into the relevant regulating cell; on the other hand, the pressure in the regulating cell can be lowered by opening a bleed valve arranged downstream of the container connection for the bleeding thereof, such that the compressed air located in the regulating cell can escape into the boat's atmosphere. These valves are controlled by signals that are generated by an assembly in accordance with the output signal of the controller module, in particular for the rate of change in the pressure difference. This assembly therefore has the task of converting the amplitude value of the controller output signal into signals adapted with the valves in terms of potential and power.

By virtue of the fact—as an embodiment of the invention further provides—that the ventilation and the bleed valves are designed to be continuously variable, the opening cross section of the relevant valves can be varied continuously such that a rapid reaction is possible without this requiring one or both valves to be switched over entirely. A regulating structure with a lower-level controller for the rate of change in the pressure difference essentially requires a corresponding continuous adjustability of the valves, since the time constant of the air stream that builds up and decays is small compared with the actuating time of the valve.

Further advantages can be achieved by using sensors for detecting the current valve positions of the ventilation and the bleed valves. The output signals of these sensors indicate whether the driven valves have assumed the desired position, or whether a deviation has occurred with reference to the predetermined value, for example as a consequence of parameter scatter, increased coefficient of friction, etc.

The use of two separate valves for the ventilation and bleeding of the relevant regulating cell offers the advantage by comparison with a reversible valve that it is possible to avoid the flowing of the air, which is valuable under water, from the supply pressure vessel into the boat's atmosphere. This succeeds, however, only when it is ensured that the two valves are never open at the same time. This purpose is served by a circuit provided within the scope of the assembly for generating drive signals for the ventilation and the bleed valves, that interlocks the drive signals for a valve with the sensor signal for the current valve position of the respective other valve. This circuit ensures that, when the flow path is switched over from one valve to the other, the complete closure of the previously opened valve is awaited until the other valve then receives an opening command.

In order to compensate deviations, induced by the most varied factors, in the actual valve position by comparison with the respectively predetermined value, within the scope of the assembly, lower-level regulating circuits for the valve position of the ventilation and/or the bleed valves should be provided for generating drive signals for the ventilation and the bleed valves. It can be ensured by a suitable design of these lower-level regulating circuits that the actual valve position always coincides to a sufficient extent with the predetermined value, so that the upstream regulating circuit may assume an idealized function of the actuators. This is also of importance insofar as it means the elimination from the controlled system of aging phenomena such as, for example, corrosion, caused by the aggressive sea air, in the region of the valves, etc.

The first component of a regulating circuit according to the invention for the position of the regulation and/or bleed valves is in each case a module for subtracting the output signal of the relevant valve position sensor from the, if appropriate interlocked, regulating signal used as set value for the valve position, in particular for the rate of change in the pressure difference, which supplies at its output a signal for the system deviation in the position of the relevant valve. The amplitude of this output signal includes information on the spacing of the current valve position from the desired valve position and can therefore be used for correction.

Finally, it corresponds to the teaching of an embodiment of the invention that the system deviation signal of the lower-level regulating circuit for the valve position is fed to the input of a controller module whose output signal is, in particular, proportional to its input signal, the integral and/or differential thereof. Here, as well, an embodiment of the invention therefore provides a continuously operating controller that ensures identity between the set value and actual value of the valve position with adequate dynamics but without overswing.

BRIEF DESCRIPTION OF THE DRAWINGS

Further features, details, advantages and effects on the basis of the invention emerge from the following description of a preferred exemplary embodiment of the invention as well as with the aid of the drawings, in which.

DETAILED DESCRIPTION OF THE PREFERRED EMBODIMENTS

Figure 1:
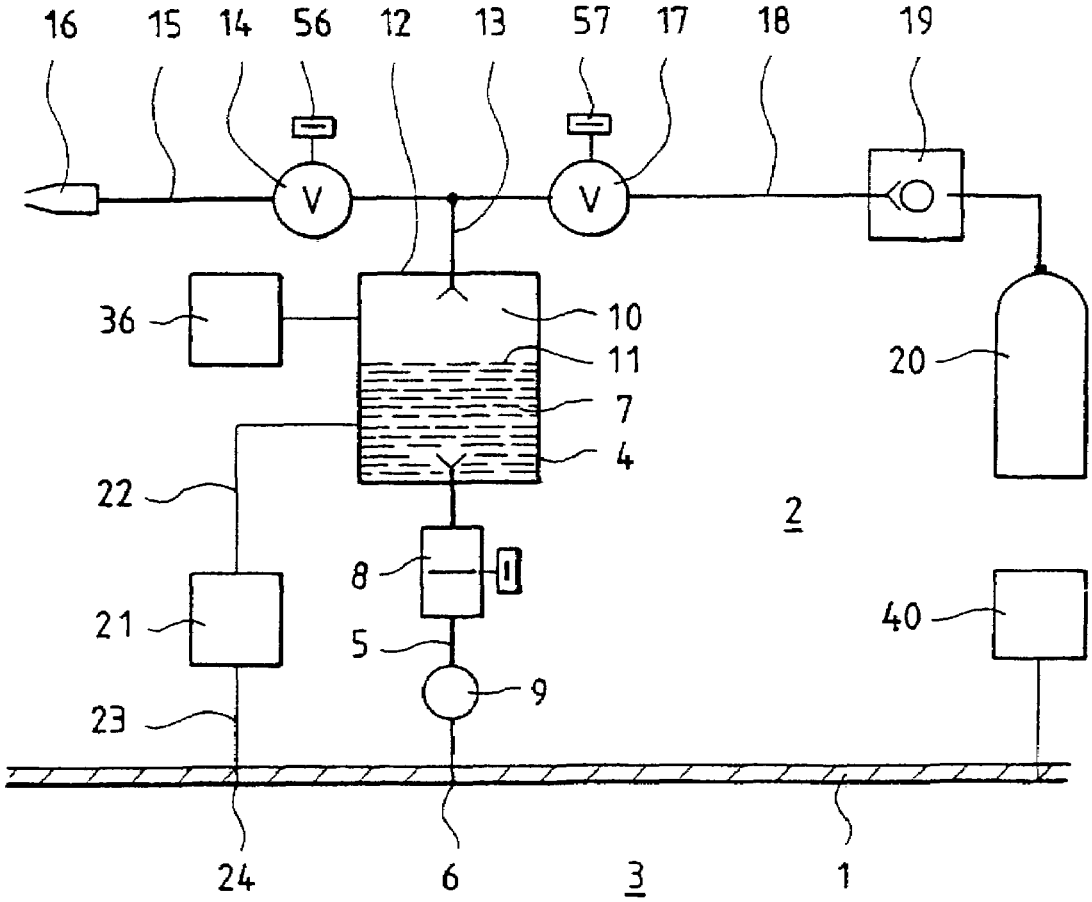
FIG. 1 shows a piping scheme with the components of an underwater vehicle that are important to an embodiment of the invention.

The boat's hull 1 separates the interior 2 of the underwater vehicle from the surrounding water masses 3.

At least one regulating cell 4 is provided in order to stabilize the underwater vehicle 1, 2 at a desired diving depth in a floating state. In addition to this regulating cell serving the coarse weight balancing of the underwater vehicle 1, 2, there can also be present further deep pumping-out cells (not illustrated in the drawing) serving the purpose of fine balance, in particular.

The regulating cell 4 has a volume of several hundreds of liters, and it is connected via a pipe 5 to an opening 6 in the boat's hull 1, such that it can be filled with water 7. The inflow is rendered possible by opening a flap 8 in the pipe 5, and the quantity of water flowing through can be monitored by a flow transmitter 9 likewise arranged in the pipe 5. Filling the regulating cell 4 with water 7 (flooding) increases its weight and thus the weight of the underwater vehicle 1, 2, such that an increased buoyancy at greater diving depths can be balanced out. On the other hand, at lower diving depths, the regulating cell 4 can be emptied (pumped out), in order thereby to reduce its weight and thus the weight of the underwater vehicle 1, 2.

The desired mass movement (flooding or pumping out of the regulating cell 4) is effected, with the flap 8 opened in each case, by setting the pressure in an air cushion 10 that is located above the water level 11 in the regulating cell 4. Provided for this purpose in the top side 12 of the regulating cell 4 is an air inlet and outlet 13 that is connected via a bleed pipe 15, which can be sealed with the aid of a valve 14, to a pipe orifice 16 leading into the boat's atmosphere. Opening this bleed valve 14 permits the air 10 to escape from the regulating cell 4 such that it is possible for a pressure equalization to take place with the pressure in the boat's atmosphere 2 down to the atmospheric pressure prevailing there. If the flap 8 is now opened, the outboard water pressure, which is increased by comparison therewith, forces water 7 through the pipe connection 5 into the regulating cell 4 such that the latter is flooded.

On the other hand, the air inlet and outlet 13 of the regulating cell 4 is connected to a further pipe 18 that can be blocked by a valve 17 and is coupled to one or more compressed air reservoirs 20 via a pressure reducer 19. Such a reservoir 20 can be, for example, a group of compressed air cylinders that can be filled by means of a compressor with the underwater vehicle surfaced. Prevailing as a result in the compressed air reservoir 20 is, depending on the degree of filling, a pressure of approximately 180 to 250 bars that is reduced by the pressure reducer 19 to an air pressure of approximately 50 bars in the ventilation pipe 18. With the ventilation valve 17 opened, compressed air 20 flows under the action of this overpressure into the regulating cell 4 and increases the pressure in the air cushion 10 there. If this pressure exceeds the outboard water pressure 3, water 7 flows off out of the regulating cell 4 when the flap 8 is open (pumping out).

An important boundary condition for the actuation of the valves 14, 17 is that both valves 14, 17 may never be open at the same time, since in such a case the compressed air 20 would escape at high speed into the boat's atmosphere 2, and the store of compressed air 20 could therefore be quickly exhausted.

It is further to be observed that the flooding of the regulating cell 4 should be avoided in the bled state, since in such a case the water 7 flows at a very high rate and thus also with an intense development of noise, through the pipe 5.

Finally, it is also to be observed that the flap 8, which is arranged in the pipe 5 "from and to the regulating cell", constitutes a comparatively sluggish entity that requires several seconds (for example 10 seconds) to close or open completely, during which large quantities of water 7 can still flow into or out of the regulating cell 4 such that, in particular, the closing operation of the flap 8 must be initiated as early as an instant at which the filling level 11 in the regulating cell 4 does not yet correspond to a desired value. The time offset by which the closing command must be brought forward is certainly largely constant, but the quantity of the water 7 still flowing through during this closing phase is also, in particular, a function of the pressure difference between the internal pressure of the regulating cell 4 and the outboard water pressure 3. The greater this pressure difference is, the greater will be the rate of flow in the pipe 5, and the quantity of water 7 still flowing through will consequently also vary. Because of a multiplicity of factors, the residual rate of flow 9 cannot be calculated without a large mathematical outlay, and yet there is no guarantee that substantial deviations will not still occur nevertheless.

Since the pressure difference between the regulating cell 4 and the outboard water pressure 3 is of substantial importance for the residual rate of flow 9 during closure of the flap 8, the invention provides to keep this pressure difference as constant as possible in the course of regulation so that it is possible to use for the residual throughflow 9 during closure of the flap 8 an experimentally determined value that can also be converted into a filling level deviation for which the closing operation of the flap 8 is then to be initiated.

Provided for the purpose of being able to adjust the pressure difference between the regulating cell 4 and the outboard water pressure 3 is a differential pressure sensor 21 that communicates for this purpose via pipe connections 22, 23 with the regulating cell 4, on the one hand, and an opening 24 in the boat's hull 1, on the other hand, and to which, as a result, the different pressure levels 3, 4 are applied from two sides. Of course, instead of being connected to the boat's hull 1 the pipe 23 can also be connected to the orifice region 6 of the pipe 5.

The task of the regulation is to correct the pressure of the air cushion 10 in the regulating cell 4 with reference to the outboard water pressure 3 by actuating the ventilation and bleed valves 7, 14 in such a way that the pressure difference 21 always corresponds to a predetermined set value 25. If this succeeds, the residual rate of flow 9 through the pipe 5 is constant during closure of the flap 8 independently of the filling level 11 in the regulating cell 4, and it is possible by using an experimentally determined lead value for the initiation of the closing operation of the flap 8 to achieve to a good approximation that the final filling level 11 established in the regulating cell corresponds fairly exactly to the desired filling level. Consequently, no difficulties arise in adjusting the weight of the underwater vehicle 1, 2 within a defined range nor, consequently, in providing stabilization at different diving depths.

Figure 2:
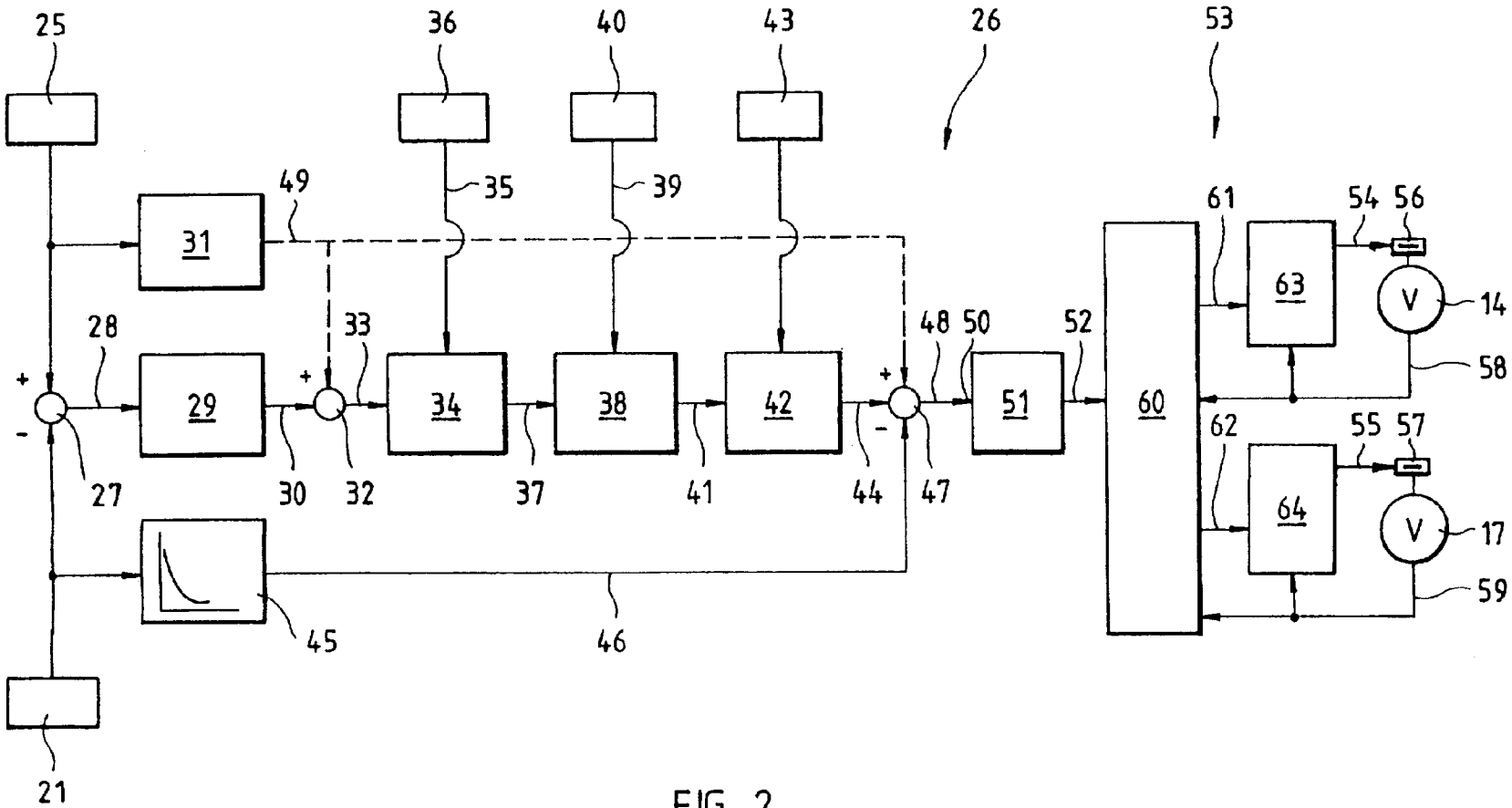
FIG. 2 shows a block diagram of the regulating circuit according to an embodiment of the invention.

The structure of the regulating circuit 26 according to an embodiment of the invention for the pressure difference between the regulating cell 4 and the outboard water pressure 3 is reproduced in FIG. 2.

To be seen is a set value transmitter 25 that can be set either manually or permanently or can, for example, be tapped by the output signal of a higher-level regulating circuit for the rate of flow 9 in the pipe 5 from and to the regulating cell 4.

The actual value supplied by the differential pressure transmitter 21 is subtracted 27 from this set value signal 25 in order to generate a signal 28 proportional to the current system deviation. Optimum preconditions for a defined actuation of the flap 8 from and to the regulating cell 4 are created if a downstream controller 29 succeeds in nulling this system deviation signal 28.

Different structures can be used within the scope of the controller module 29, but it is preferred here to use a controller with a proportional component and an integral-action component, since such a controller is capable, given adequate dynamics, of permanently nulling a system deviation. It is possible, if appropriate, to dispense at this juncture with a differential component, in order as far as possible to stabilize the regulation. Instead of this, it is possible to superimpose the signal of a precontrol block 31 additively on the output signal 30 of the regulator 29, as a result of which, for example, the dynamics is improved in the case of changes in the set value 25. The precontrol system 31 can be designed for this purpose as a differentiating module, for example.

Furthermore, the regulating signal 33 dynamized in such a way can be modified in further, downstream assemblies and can thereby be adapted to the current boundary conditions.

It is possible in this case within the scope of a first modification model 34 to undertake a combination with the output signal 35 of a sensor 36 for the filling level 11 in the regulating cell 4. It is thereby possible to take account of the fact that with rising filling level 11 the volume of the air cushion 10 decreases, and therefore even relatively small amounts of inflowing or outflowing air contribute to respectively amplified pressure changes in the regulating cell 4. It is possible here to achieve a correction by calculating the volume of the air cushion 10 by subtracting the currently measured filling level 36 from the maximum filled state of the regulating cell 4, and then combining this value multiplicatively, for example, with the regulating signal 33 so that in the case of a large air cushion 10 with a correspondingly large regulating signal 37 a correspondingly wide adjustment of the valves 14, 17 is effected, while in the case of a high filling level 36 the valve adjustment is correspondingly retracted.

In addition to the regulating signal 27 corrected for filling level, a further modification module 38, preferably connected in series, receives the output signal 39 of a sensor 40 for the outboard water pressure 3. The modification module 38 can use this information to estimate, for example, the current diving depth of the underwater vehicle 1, 2. Its predominant task resides in effecting an attenuation of the regulating signal 41 at low diving depths such that the regulating does not start to oscillate despite the influence of the wave motion, which is strongly in evidence in this region.

A further modification module 42 is coupled, on the one hand, to the regulating signal 41 corrected for diving depth and, on the other hand, to a set value transmitter 43 at which the current noise requirement can be set. In accordance with the noise reduction preselectable here, the regulating signal 44 can additionally be bounded so that the valves 14, 17 are opened only to a restricted extent and therefore produce only a minimum of noise.

In accordance with the teaching of an embodiment of the invention, such a modified regulating signal 44 is not, however, used directly to drive the valves 14, 17 but rather as set value for regulating the rate of change in the pressure difference 21. In order here to obtain a current comparison value, a downstream module 45 uses the measured pressure difference 21 to form a differential function in order to obtain in this way an actual value signal 46 for the rate of change in the pressure difference 21. This actual value 46 is subtracted by a subtraction module 47 from the modified regulating signal 44, used as set value, in order to make available a signal 48 for the system deviation.

As an alternative or in addition to looping in the output signal 49 of the precontrol assembly 31 at the output 30 of the controller 29, said signal can also be attached additively to the system deviation signal 48, preferably at an input of the subtraction module 47 that is parallel to the set value signal 44.

The system deviation signal 48, dynamized in such a way if appropriate, is communicated to the input 50 of a lower-level controller 51, the task of which is to generate a suitable controlling signal 52 so as to affect the controlled system 4 in such a way that the actual value 46 for the rate of change in the pressure difference 21 corresponds as exactly as possible to the set value signal 44 in the stationary state. The controller 51 of the lower-level regulating circuit for the rate of change 46 in the pressure difference 21 can also be constructed with a proportional and integral-action as well as, if appropriate, a differential component, although the latter can also be omitted for the purpose of stabilizing the regulating circuits behavior.

Connected downstream of the controller 51 is a drive assembly 53 whose task is to convert the regulating signal 52 of the lower-level controller 51 into drive signals 54, 55 for the actuating devices 56, 57 of the air control valves 14, 17.

As already mentioned, it is necessary in this case to ensure that the two valves 14, 17 are never open at the same time, since otherwise the compressed air 20 would escape unused into the boat's atmosphere 2. For this purpose, each of the two valves 14, 17 is assigned a valve position sensor whose output signals 58, 59 are fed back to the drive assembly 53. There, they can be used by an interlocking assembly 60 for the purpose of not releasing a valve opening set value 61, 62 derived from the controller output signal 52 until the respective other valve 14, 17 has already previously been definitively closed as shown by the relevant check-back signal 58, 59.

Furthermore, the valve opening set value 61, 62 generated in such a way is not connected directly to the actuating device 56, 57 of the relevant valve 14, 17, but fed as set value to a valve position controller 63, 64 that also receives, in addition, the check back signal 58, 59 of the relevant valve position sensor. From this, the valve position controller 63, 64 can determine the deviation in the current valve position 58, 59 with reference to the valve opening set value 61, 62 originating from the interlocking assembly 60, and use a fixed regulating function to generate appropriate drive signals 54, 55 for the actuating device 56, 57 of the relevant valve 14, 17. It is thereby possible always to be able to observe the desired valve position value independently of whether the valves exhibit deviating properties owing to aging, corrosion or other influences. If, in addition to a proportional component, the lower-level valve position controllers 63, 64 also obtain an integral-action component, this ensures that in the stationary state the actual valve positions 58, 59 correspond to the predetermined position set value 61, 62 and so the higher-level controller 51 for the rate of change in the pressure difference 21 can assume that its controller output signal 52 is impressed on the air control valves 14, 17. Aging phenomena in the valves or other devices are therefore ruled out, and the regulating circuit 26 according to an embodiment of the invention operates over many years in an extremely reliable fashion.

Discrete electronic modules operating in an analog fashion can be used for the various assemblies of the regulating system 26, but it is also possible alongside this to implement one, a plurality or all the signal processing assemblies as a computer program in the data processing installation. In such a case, the mostly analog signals of the sensors 21, 36, 40, 58, 59 and also the set values 25, 43, provided by means of potentiometer, for example, can be digitized via analog-to-digital converters and then entered in a bitwise fashion. The output signals of the valve position controllers 63, 64, for example, can then be converted with the aid of digital-to-analog converters into corresponding voltage levels that are then adapted to the actuating devices 56, 57 in terms of power by use of downstream amplifiers.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for operating an underwater vehicle, comprising:

detecting a pressure in a container, fillable with water and a gas for varying the vehicle weight; and regulating a pressure difference between the pressure in the container and outboard water pressure, wherein the pressure difference is regulated to a predeterminable set value for regulating a volume through-put of water between the outboard water and the container to a constant value.

2. The method as claimed in claim 1, further comprising:

measuring an actual value of the pressure difference between the pressure in the container and the outboard water pressure.

3. The method as claimed in claim 2, wherein the measuring step includes subtracting the measured actual value of the pressure difference from the predetermined set value in order to obtain a measure of the system deviation.

4. The method as claimed in claim 1, wherein, in the course of the regulation for the pressure difference, at least one of a function proportional to the system deviation, its integral and a differential is formed as a regulating signal.

5. The method as claimed in claim 4, wherein, in order to improve the dynamics in the event of set value changes, the regulating signal is combined additively with a signal, derived from the set value, to form a dynamized regulating signal.

6. The method as claimed in claim 5, wherein the dynamized regulating signal is influenced by one or more signals.

7. The method as claimed in claim 6, wherein the dynamized regulating signal is modified by a filling level measured value for the container that can be filled for the purpose of varying the vehicle weight, in order to obtain a regulating signal corrected for filling level.

8. The method as claimed in claim 7, wherein the regulating signal, at least one of dynamized and corrected for filling level, is modified by a pressure signal for the outboard pressure, in order to obtain a regulating signal corrected for diving depth.

9. The method as claimed in claim 8, wherein the regulating signal, at least one of dynamized, corrected for filling and corrected for diving level, is bounded in order to correspond to further set values.

10. The method as claimed in claim 9, wherein the pressure difference regulating signal, at least one of dynamized, corrected for filling level, corrected for diving depth, and bounded, is used as set value for a lower-level regulation for the rate of change of the pressure difference.

11. The method as claimed in claim 10, further comprising:

calculating the rate of change of the pressure difference actual value calculated by differentiation from the measured actual value of the pressure difference between the pressure in the relevant container and the outboard water pressure.

12. The method as claimed in claim 11, wherein, in order to obtain a measure of the system deviation of the lower-level regulation for the rate of change of the pressure difference, the rate of change of the pressure difference actual value is subtracted from the regulating signal, used as set value signal and modified of the higher-level regulation for the pressure difference between the pressure in the container and the outboard water pressure.

13. The method as claimed in claim 12, wherein, in order to improve the dynamics in the event of set value changes, the system deviation of the lower-level regulation for the rate of change of the pressure difference is combined additively with a signal derived from the pressure difference set value to form a dynamized system deviation signal.

14. The method as claimed in claim 13, wherein, in the course of the lower-level regulation for the rate of change in the pressure difference, a function proportional to the possibly dynamized system deviation, at least one of its integral and differential is formed as regulating signal for the rate of change in the pressure difference.

15. The method as claimed in claim 1, wherein the regulating signal is used to derive drive signals for a ventilation valve, arranged upstream of the container connection for a gaseous pressure medium, and for a bleed valve arranged downstream of the container connection for the pressure medium.

16. The method as claimed in claim 15, wherein the drive signals for the valves effect a continuous adjustment of the same.

17. The method as claimed in claim 16, wherein the current valve positions are detected.

18. The method as claimed in claim 17, wherein the drive signals for the valves are interlocked with the current valve position of the respective other valve.

19. The method as claimed in claim 18, wherein the drive signals for the valves are obtained from the regulating signal.

20. The method as claimed in claim 19, wherein in the course of a valve position regulation, the detected valve position value is subtracted from the regulating signal used as set value and modified by interlocking in order to obtain a measure of the system deviation.

21. The method as claimed in claim 20, wherein, in the course of the valve position regulation, a function proportional to at least one of the system deviation of the valve position, its integral and differential is formed as drive signal for the relevant valve.

22. The method as claimed in claim 1, wherein the gas is air.

23. The method as claimed in claim 2, wherein, in the course of the regulation for the pressure difference, at least one of a function proportional to the system deviation, its integral and a differential is formed as regulating a signal.

24. The method as claimed in claim 1, wherein, in the course of the regulation for the pressure difference, at least one of a function proportional to the system deviation, its integral and a differential is formed as regulating a signal.

25. The method as claimed in claim 9, wherein the regulating signal, at least one of dynamized, corrected for filling and corrected for diving level, is bounded in order to correspond to further set values regarding a noise requirement.

26. The method as claimed in claim 2, further comprising:

calculating the rate of change of the pressure difference actual value calculated by differentiation from the measured actual value of the pressure difference between the pressure in the relevant container and the outboard water pressure.

27. The method as claimed in claim 15, wherein the regulating signal is for the rate of change in the pressure difference.

* * * * *